US008100267B2

(12) United States Patent
Lin et al.

(10) Patent No.: US 8,100,267 B2
(45) Date of Patent: Jan. 24, 2012

(54) SORTING DEVICE

(75) Inventors: Dong-Sheng Lin, Taipei Hsien (TW); Tzyy-Chyi Tsai, Taipei Hsien (TW); Hai-Xia Zeng, Shenzhen (CN); Yun-Qing Jiang, Shenzhen (CN)

(73) Assignees: Hong Fu Jin Precision Industry (ShenZhen) Co., Ltd., Shenzhen (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 303 days.

(21) Appl. No.: 12/555,932

(22) Filed: Sep. 9, 2009

(65) Prior Publication Data

US 2010/0256806 A1 Oct. 7, 2010

(30) Foreign Application Priority Data

Apr. 3, 2009 (CN) ..... 2009 1 0301361

(51) Int. Cl.
*B07C 5/00* (2006.01)

(52) U.S. Cl. ..... 209/552; 209/3.3; 209/569; 209/583; 209/617

(58) Field of Classification Search ..... 209/3.3, 209/552, 569, 583, 617; 700/223, 224
See application file for complete search history.

(56) References Cited

U.S. PATENT DOCUMENTS 3,021,006 A * 2/1962 Beckman, Jr. ..... 209/3.3
5,913,652 A * 6/1999 Zejda ..... 414/226.01
6,011,998 A * 1/2000 Lichti et al. ..... 700/230

* cited by examiner

*Primary Examiner* — Terrell Matthews
(74) *Attorney, Agent, or Firm* — Altis Law Group, Inc.

(57) ABSTRACT

A sorting device includes a feed mechanism, a plurality of unloading mechanisms, a support mechanism, a measurement mechanism, a marking mechanism, and a plurality of transfer mechanisms. The plurality of transfer mechanisms is between the support mechanism and the feed mechanism or the plurality of unloading mechanisms, the measurement mechanism and the marking mechanism are on one side of the support mechanism and aim at different stations of the support mechanism.

18 Claims, 8 Drawing Sheets

SORTING DEVICE

BACKGROUND

1. Technical Field

The present disclosure generally relates to manufacturing, and more particularly to a sorting device applied in manufacturing.

2. Description of Related Art

Since various workpieces may differ in size, a procedure measuring and classifying the workpieces is necessary before assembly.

Generally, the workpieces are fed to a sorting device one by one to be measured. The workpieces are marked accordingly, the results recorded, and the workpieces are unloaded from the sorting device and placed into corresponding trays.

After sorting, workpieces with minor differences may be sorted into a common designation and assembled with similar-sized components, so that the precision assembly is improved. However, other procedures such as feeding, marking, recording, unloading, and placement are performed manually. Therefore, the procedure can require considerable time and manpower. Further, errors, such as mismarking, misplacement, and other potential manual caused errors are common in such manual operations. The precision of the assembly is thus degraded.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
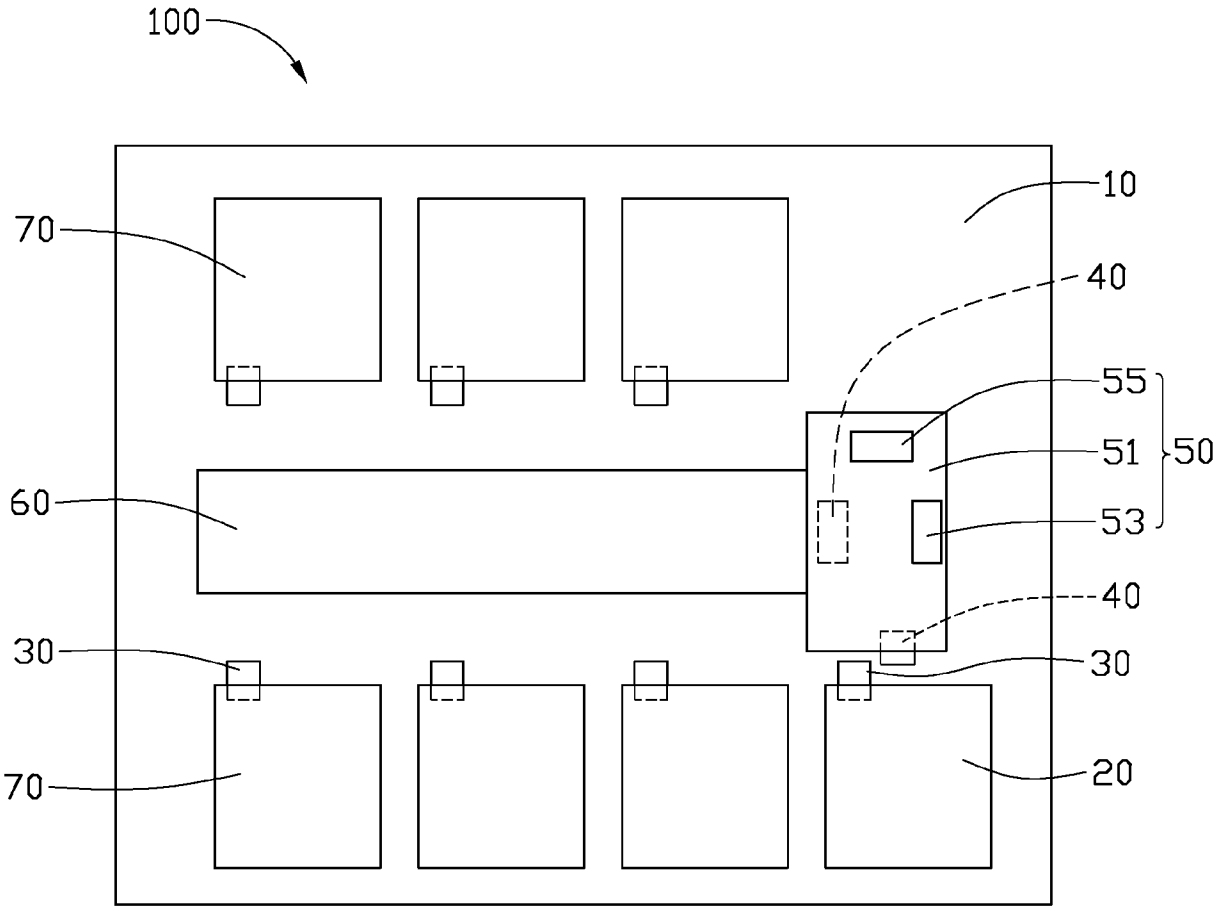
FIG. 1 is a schematic view of an embodiment of a sorting device, the sorting device including a feed mechanism, a plurality of transfer mechanisms, two relocating mechanisms, a support mechanism, a measurement mechanism, a marking mechanism, and a plurality of unloading mechanisms.

Referring to FIG. 1, an embodiment of a sorting device 100 includes a supporting frame 10, a feed mechanism 20, a plurality of transfer mechanisms 30, two relocating mechanisms 40, a classification module 50, a conveyance mechanism 60, and a plurality of unloading mechanisms 70. The feed mechanism 20 is adjacent to the classification module 50, and the unloading mechanisms 70 are on opposite sides of the conveyance mechanism 60. The feed mechanism 20 and the unloading mechanisms 70 are supported by the supporting frame 10. The transfer mechanisms 30, relocating mechanisms 40, classification module 50, and the conveyance mechanism 60 are fixed on the supporting frame 10.

Figure 2:
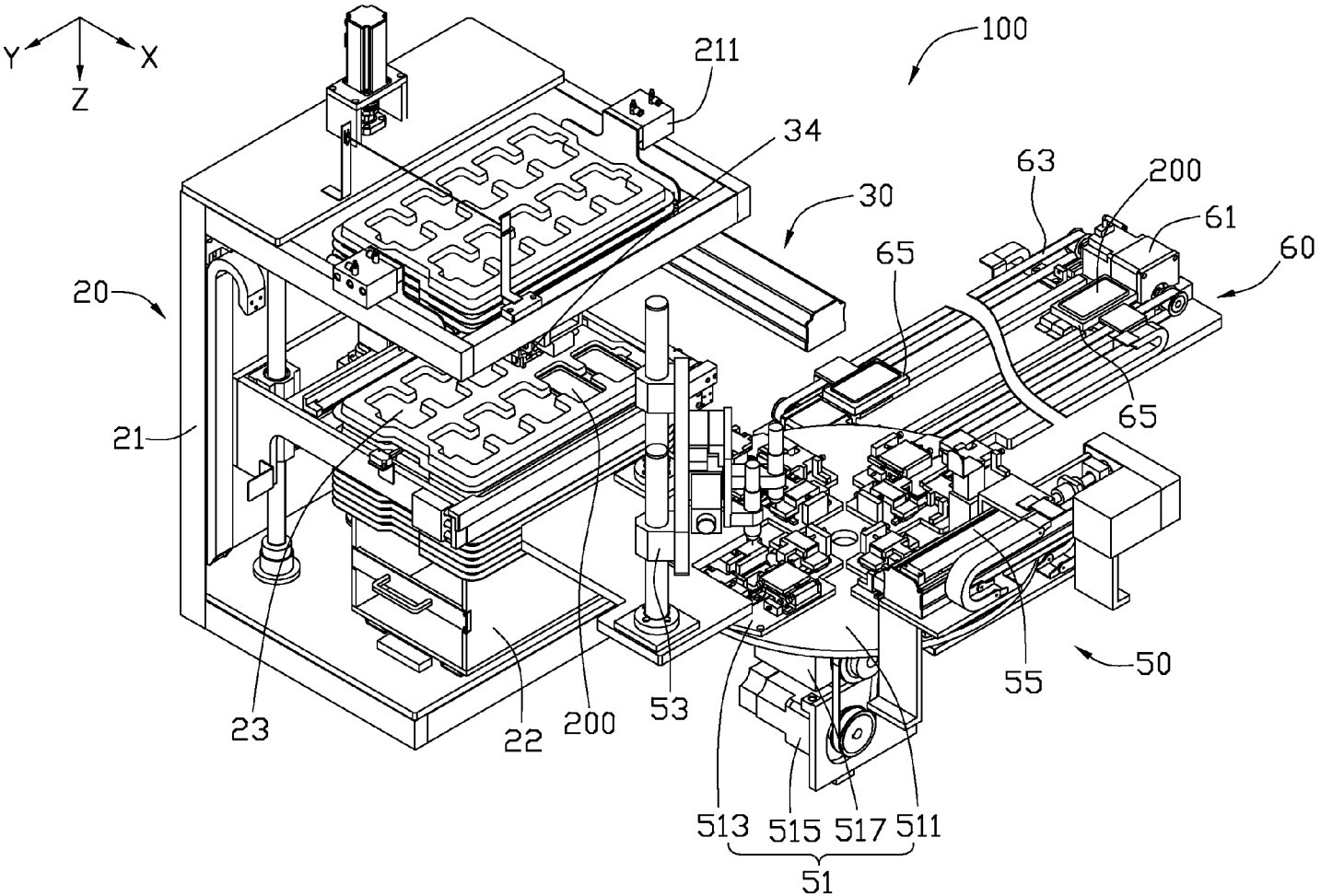
FIG. 2 is an isometric view of a part of the sorting device of FIG. 1.
Figure 3:
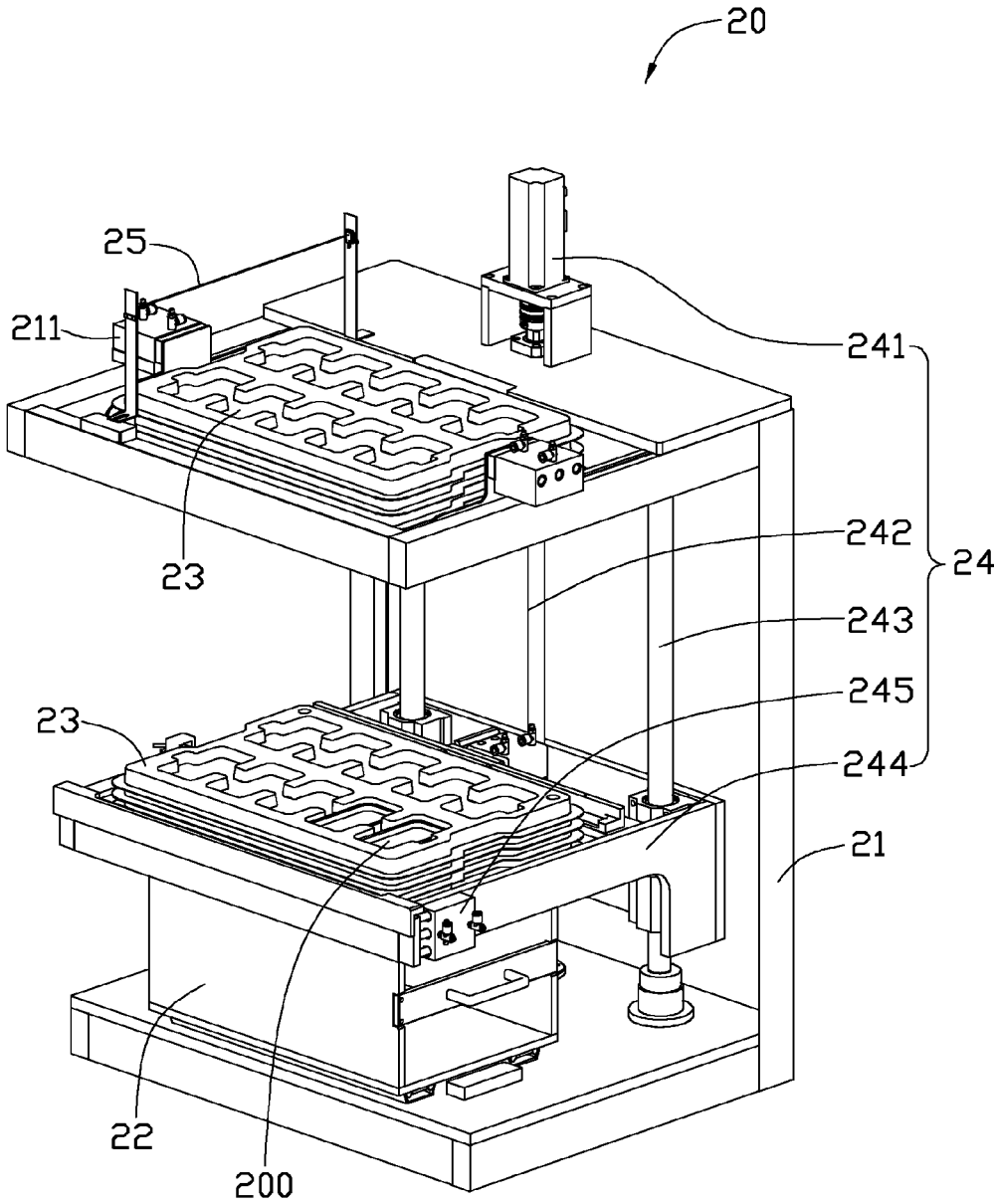
FIG. 3 is an isometric view of the feed mechanism of the sorting device in FIG. 1.

Referring to FIG. 2 and FIG. 3, the feed mechanism 20 is adjacent to the classification module 50. The feed mechanism 20 includes a support bracket 21, a drawer 22 slidably positioned in the support bracket 21, a plurality of trays 23 positioned on the drawer 22 and a top of the support bracket 21, a drive assembly 24 on the support bracket 21, and a sensor 25 on the top of the support bracket 21.

The support bracket 21 includes two clipping cylinders 211 disposed on the top thereof, and the drawer 22 is disposed on a bottom wall thereof.

The drive assembly 24 includes a servo motor 241, a threaded shaft 242 rotated by the servo motor 241, two guide bars 243 disposed on two sides of the threaded shaft 242, a holding member 244 sleeved on the threaded shaft 242 and the guide bars 243, and a pneumatic cylinder 245 fixed on the holding member 244. The servo motor 241 may be another driving member, such as another pneumatic cylinder, a hydraulic cylinder, or others, as may the pneumatic cylinder 245.

In the illustrated embodiment, the sensor 25 is a fiber sensor. The sensor 25 determines the height of the trays 23 stacked on the support bracket 21. The sensor 25 may be a laser sensor, a mechanical sensor, or other sensors instead.

In use, when the trays 23 bearing the pre-sorted workpieces 200 are deposited on the drawer 22, the holding member 244 of the drive assembly 24 is elevated to a predetermined height. After depositing the trays 23, the holding member 244 lowers to surround the trays 23. The tray 23 simply contacts others without being locked, and can be easily detached.

When the pre-sorted workpieces 200 in the top of one of the trays 23 are removed, the holding member 244 and the pneumatic cylinder 245 of the drive assembly 24 clip the empty tray 23 and move toward the top of the support bracket 21 along the threaded shaft 242 and the guide bars 243. The clipping cylinders 211 on the top of the support bracket 21 clip the empty tray 23. The sensor 25 monitors the height of the trays 23 stacked on the support bracket 21, and sends a notification to remove the trays 23.

Figure 4:
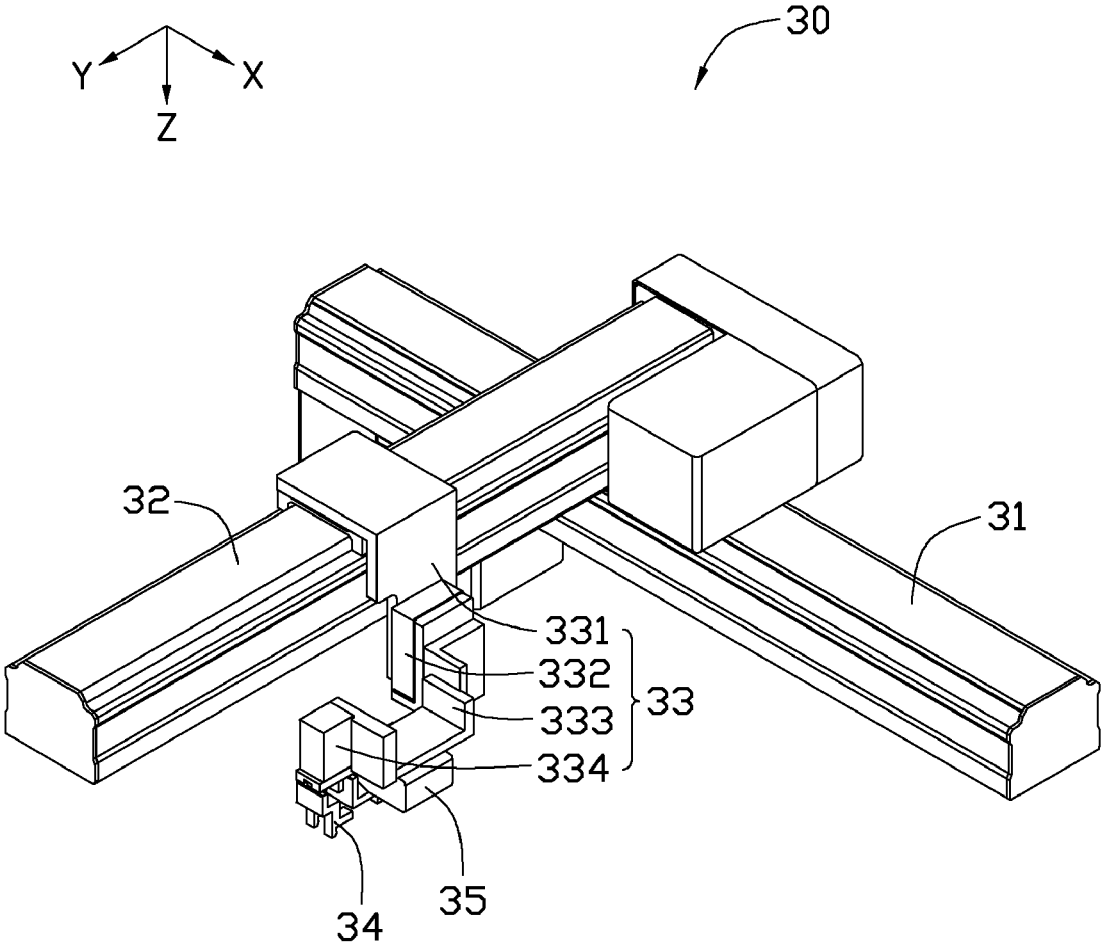
FIG. 4 is an isometric view of one transfer mechanism of the sorting device in FIG. 1.

Referring to FIG. 2 and FIG. 4, each transfer mechanism 30 includes a first slide-rail 31 on the X-axis, a second slide-rail 32 on the Y-axis, a moving member 33 on the Z-axis, a claw 34 connected with the moving member 33, and an encoder 35 fixed on the moving member 33.

The moving member 33 includes a sliding member 331 slidably mounted on the second slide-rail 32, a pneumatic cylinder 332 fixed on the sliding member 331, a connecting member 333 fixed on the pneumatic cylinder 332, and another pneumatic cylinder 334 fixed on an end of the connecting member 333.

The claw 34 connects with the pneumatic cylinder 334 and moves along the X-axis controlled by the pneumatic cylinders 332, 334. The claw 34 can grasp the pre-sorted workpieces 200 from the feed mechanism 20 or deposit the pre-sorted workpieces 200 to the unloading mechanisms 70.

Since the pre-sorted workpieces 200 are marked with identification codes of production date, time, and other information, when the claw 34 grasps one pre-sorted workpiece 200, the encoder 35 reads the identification codes on the pre-sorted workpiece 200 and uploads the data to a control system (not shown) of the sorting device 100, so as to locate a working station which induces the disqualification.

Figure 5:
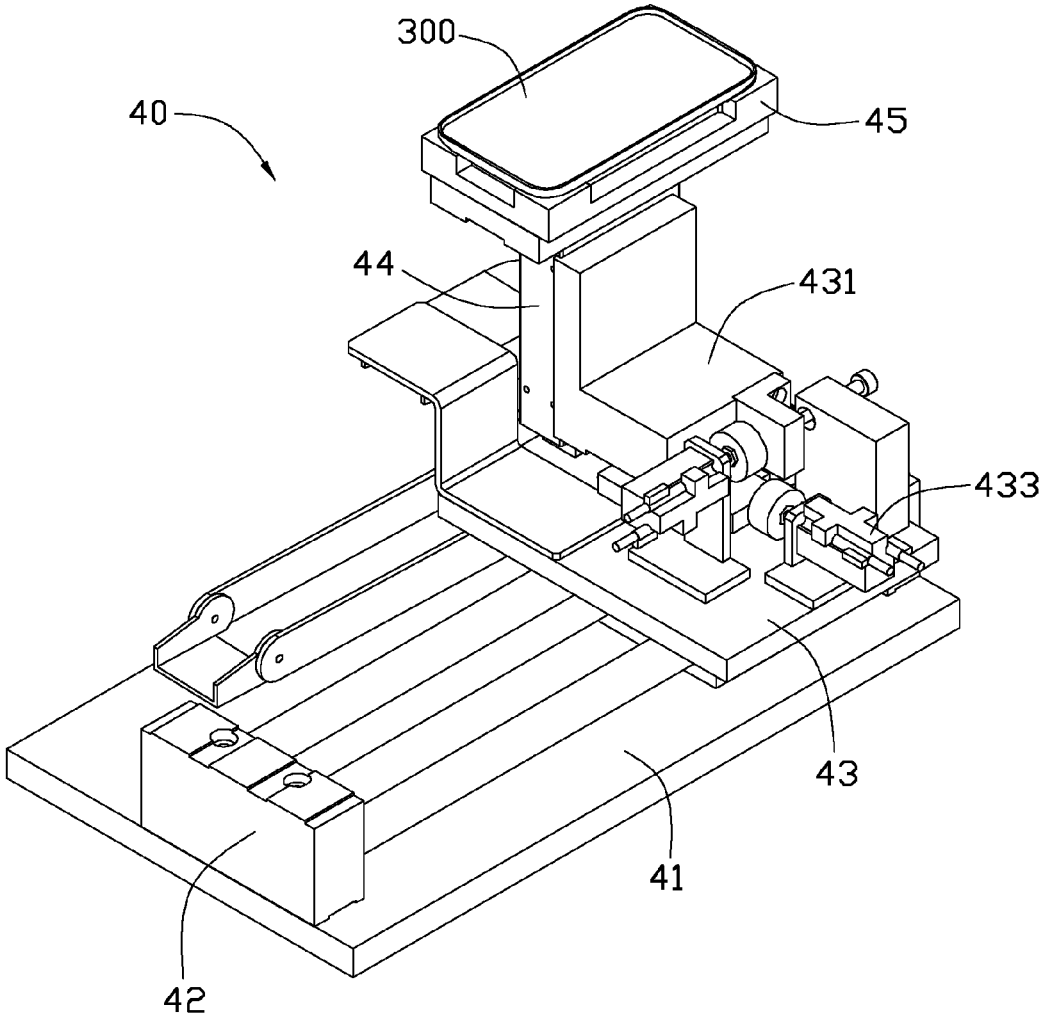
FIG. 5 is an isometric view of one relocating mechanism of the sorting device in FIG. 1.

Referring to FIG. 5, each relocating mechanism 40 includes a supporting board 41, a first pneumatic cylinder 42 fixed on the supporting board 41, a sliding stage 43 driven by the first pneumatic cylinder 42, a second pneumatic cylinder 44 fixed on the sliding stage 43, and a supporting stage 45 driven by the second pneumatic cylinder 44.

The sliding stage 43 includes a fixing member 431 and a plurality of adjusting members 433. The adjusting members 433 resist the fixing member 431 to adjust the position of the fixing member 431, thereby, the position of the supporting stage 45 is adjustable.

The second pneumatic cylinder 44 can drive the supporting stage 45 to move along a direction substantially perpendicular to the driving direction of first pneumatic cylinder 42. The supporting stage 45 can support a pre-sorted workpiece 200 thereon. The first pneumatic cylinder 42 and the second pneumatic cylinder 44 may be hydraulic cylinders, electromotors, or other driving members.

Figure 6:
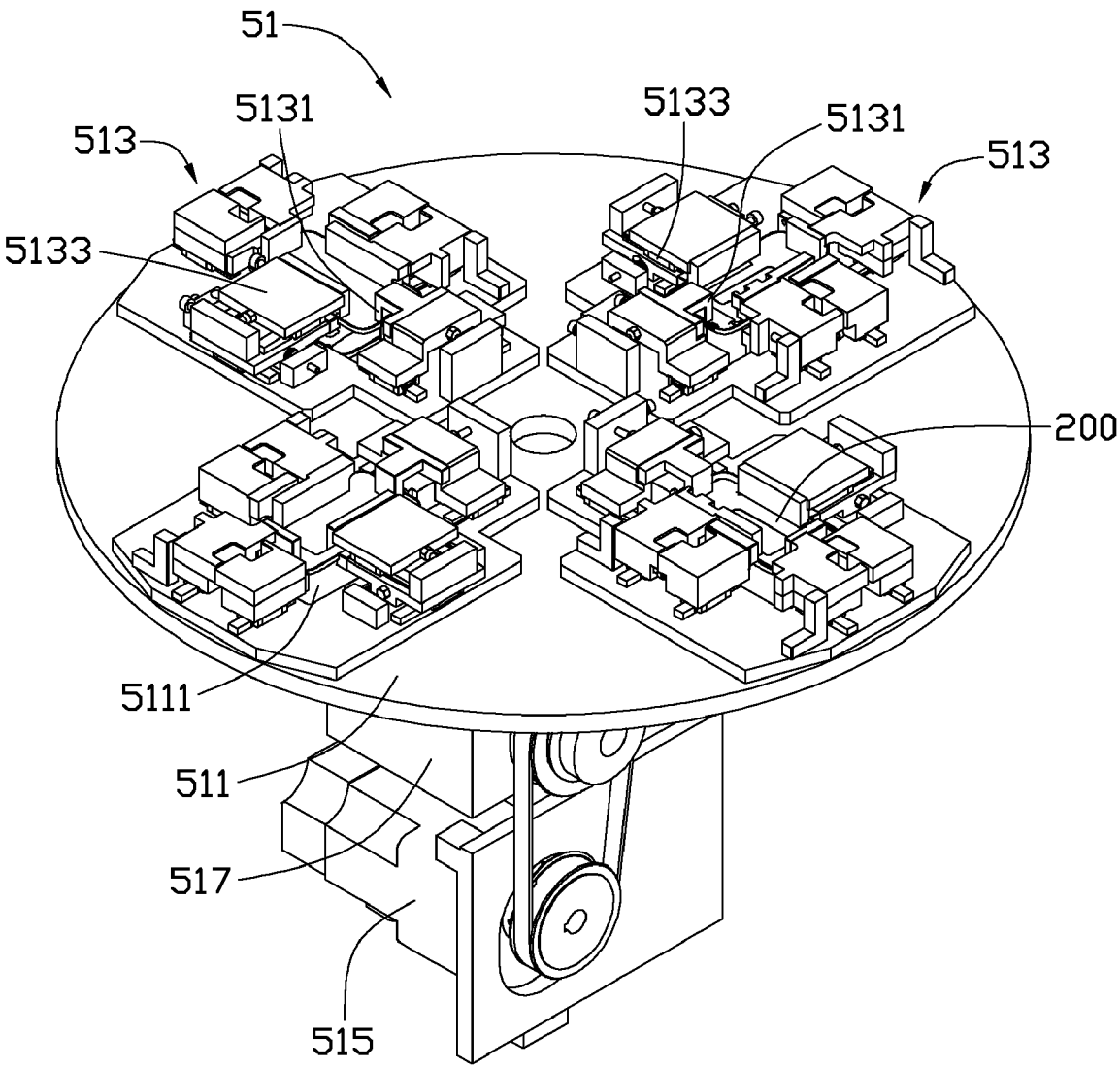
FIG. 6 is an isometric view of the support mechanism of the sorting device in FIG. 1.

Referring to FIG. 2 and FIG. 6, the classification module 50 includes a support mechanism 51, a measurement mechanism 53, and a marking mechanism 55. The measurement mechanism 53 and the marking mechanism 55 are on a same side of the support mechanism 51. In the illustrated embodiment, the measurement mechanism 53 and the marking mechanism 55 are positioned over the support mechanism 51.

The support mechanism 51 includes a turntable 511, four clipping assemblies 513 fixed on an upside of the turntable 511, an electromotor 515 and an angle divider 517 fixed on a downside of the turntable 511. The turntable 511 includes four stations where the clipping assemblies 513 are positioned. The clipping assemblies 513 are disposed on the turntable 511 and are 90° apart, which includes four clipping legs 5131 and four pneumatic cylinders 5133 driving the corresponding clipping leg 5131. The turntable 511 defines four openings 5111 in the portions among the clipping legs 5131 of each clipping assembly 513, and each opening 5111 is slightly larger than a size of the pre-sorted workpieces 200. The clipping legs 5131 driven by the cylinders 5133 can clip an inner side of the pre-sorted workpieces 200 transferred under the opening 5111. The angle divider 517 can control the turntable 511 to pause after turning through each 90°. The number of the clipping assemblies 513, the clipping legs 5131, and the openings 5111 in the turntable 511 may be varied as desired.

Figure 7:
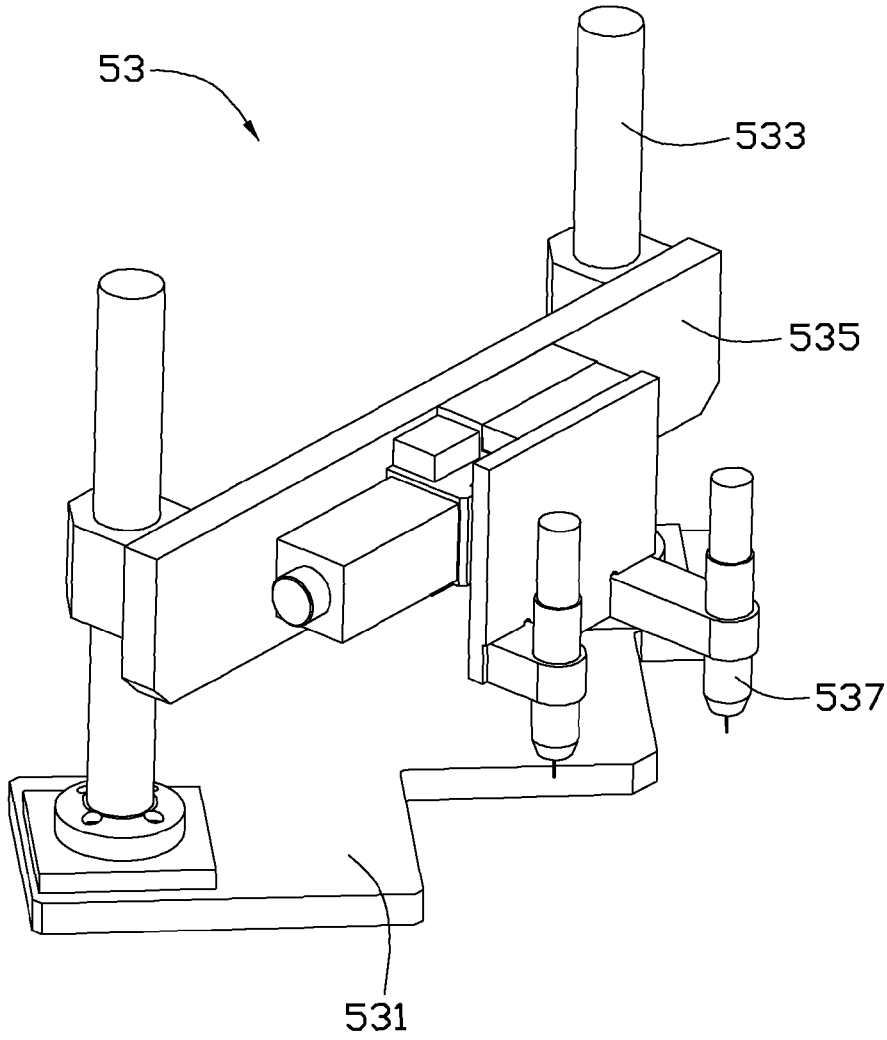
FIG. 7 is an isometric view of the measurement mechanism of the sorting device in FIG. 1.

Referring to FIG. 2 and FIG. 7, the measurement mechanism 53 includes a base board 531, two shafts 533 fixed on the base board 531, a connecting board 535 connecting the two shafts 533, and two gauging heads 537 connected to the connecting board 535. The base board 531 can be fixed on the supporting frame 10 of the sorting device 100. The gauging heads 537 measure the pre-sorted workpieces 200 on the turntable 511 and upload the measuring result to the control system (not shown) of the sorting device 100.

Figure 8:
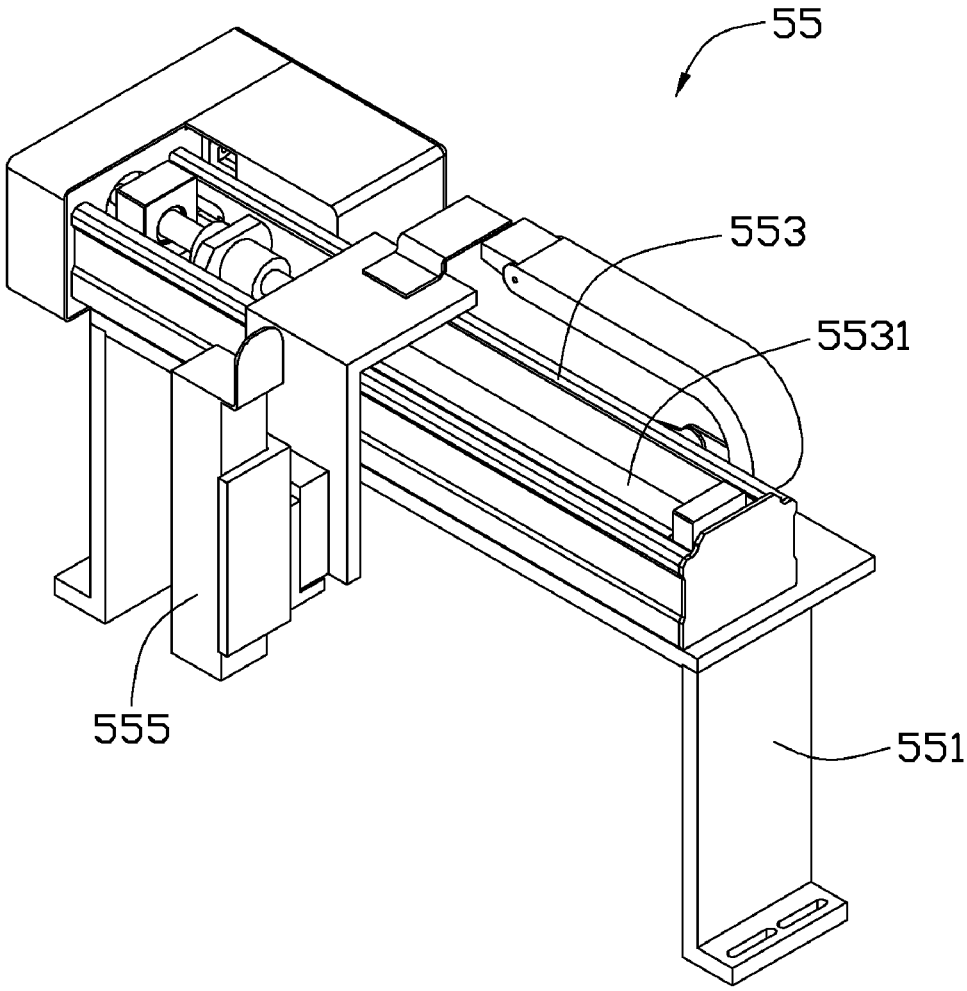
FIG. 8 is an isometric view of the marking mechanism of the sorting device in FIG. 1.

Referring to FIG. 2 and FIG. 8, the marking mechanism 55 includes two supporting legs 551, a sliding rail 553 supported by the supporting legs 551, and a marking head 555 slidably positioned on the sliding rail 553. The marking mechanism 55 is fixed on the supporting frame 10 (not shown) of the sorting device 100. In the illustrated embodiment, the sliding rail 553 includes a threaded shaft 5531 disposed therein. The threaded shaft 5531 may be a pneumatic cylinder or a hydraulic cylinder.

The measurement mechanism 53 and the marking mechanism 55 are arranged over the support mechanism 51 and targets different stations of the support mechanism 51. Two relocating mechanisms 40 are under the turntable 511 of the support mechanism 51.

Referring to FIG. 2, the conveyance mechanism 60 includes an electromotor 61, two transmission belts 63, and two clamps 65 adjacent to and moving together with the transmission belts 63. The electromotor 61 is positioned between the transmission belts 63 and drives the transmission belts 63 to move. The electromotor 61 can be another driving member, such as a pneumatic cylinder, a hydraulic cylinder, and so on.

Referring to FIG. 1 and FIG. 2, the unloading mechanisms 70 which are on two sides of the conveyance mechanism 60 have the same structure and functionality as the feed mechanism 20. The unloading mechanisms 70 may also be on one side of the conveyance mechanism 60, in which the conveyance mechanism 60 may be lengthened.

Referring to FIG. 1, FIG. 2, and FIG. 5, in use, when the trays 23 bearing the pre-sorted workpieces 200 are deposited on the feed mechanism 20, the claw 34 of the transfer mechanism 30 moves one pre-sorted workpiece 200 to the relocating mechanism 40 adjacent to the feed mechanism 20.

One relocating mechanism 40 carries the pre-sorted workpiece 200 to one of the clipping assemblies 513 on the turntable 511 of the support mechanism 51, and the clipping assembly 513 clips the pre-sorted workpiece 200. The turntable 511 rotates through 90° to position the pre-sorted workpiece 200 under the measurement mechanism 53. The measurement mechanism 53 measures the pre-sorted workpiece 200 and uploads the result to the control system. The control system classifies the pre-sorted workpiece 200 according to the measuring result. The turntable 511 continues to rotate through 90° so that the marking mechanism 55 can mark a corresponding classification code on the pre-sorted workpiece 200. The turntable 511 continues to rotate through another 90° to position the sorted workpiece 200 over the other relocating mechanism 40 adjacent to the conveyance mechanism 60, where the relocating mechanism 40 removes the sorted workpiece 200 from the support mechanism 51 to the conveyance mechanism 60.

The sorted workpiece 200 can be removed to one of the clamps 65 of the conveyance mechanism 60 from the relocating mechanism 40 by a robot manipulator (not shown). The control system directs the conveyance mechanism 60 to relocate the sorted workpiece 200 adjacent to a corresponding unloading mechanism 60, and the transfer mechanism 30 transfers the sorted workpiece 200 to the unloading mechanism 60.

When the relocating mechanism 40 relocates the pre-sorted workpiece 200 to the classification module 50, the first pneumatic cylinder 42 slides the sliding stage 43, whereby the pre-sorted workpiece 200 is disposed under one of the openings 5111 (referring to FIG. 6) of the turntable 511. The second pneumatic cylinder 44 of the relocating mechanism 40 elevates the supporting stage 45, such that the pre-sorted workpiece 200 on the supporting stage 45 can be disposed under the opening 5111 and clipped by the clipping assembly 513. After that, the sliding stage 43 of the relocating mechanism 40 is lowered and moved away from the opening 5111.

In the sorting device 100 as disclosed, the measurement mechanism 53 and the marking mechanism 54 are both disposed over the support mechanism 51. Consequently, when a pre-sorted workpiece 200 is positioned on the support mechanism 51, the pre-sorted workpiece 200 can be measured and marked successively after being clipped by the clipping assembly 513. Accordingly the pre-sorted workpiece 200 need not be clipped before each measuring procedure and each marking procedure, and the entire procedure is shortened.

In the sorting device 100 as disclosed, the sorted workpieces 200 are relocated to different portions adjacent to corresponding unloading mechanisms 70, and transferred to the corresponding unloading mechanisms 70 by the transfer mechanisms 30. The sorted workpieces 200 can thus be sorted and transferred to the corresponding unloading mechanisms 70 quickly. As a result, the sorted workpieces 200 are not stockpiled, and the sorting device 100 functions unhindered.

In use, the transfer, relocation, measuring, marking, and sorting are carried out by the sorting device 100, such that manual components of the process are restricted to placement of the trays 23 bearing the pre-sorted workpieces 200 to the feed mechanism 20, and removal of the same therefrom. Manpower requirements are reduced, and efficiency of entire procedure is increased. In addition, the incidence of the sorting device 100 break down during the sorting is reduced, with efficiency thus also improved. Furthermore, sorting carried out by the sorting device 100 is considerably less prone to error, improving precision.

In the sorting device 100, a plurality of clipping assemblies 513 is disposed on the turntable 511 of the support mechanism 51, such that relocating mechanisms 40, the measurement mechanism 53, and marking mechanism 54 of the classification module 50 may work on different pre-sorted workpieces 200 clipped by different clipping assemblies 513 at the same time, thus improving utilization rate of the classification module 50.

In the sorting device 100, the encoder 35 moves together with the claw 34, so that as the pre-sorted workpiece 200 is moved by the claw 34, the encoder 35 reads the code on the sorted workpiece 200. Thus the time spent reading code is conserved.

In alternative embodiments, the relocating mechanism 40 may be omitted, in which case pre-sorted workpieces 200 are transferred to the classification module 50 from the feed mechanism 20 by the transfer mechanism 30 directly. Correspondingly, the clipping legs 5131 (referring to FIG. 6) of the clipping assemblies 513 on the turntable 511 clip the workpieces 200 from the top. The conveyance mechanism 60 may also be omitted, in which case the feed mechanism 20 and the unloading mechanisms 70 surround the support mechanism 51 of the classification module 50, and a plurality of transfer mechanisms 30 are between the classification module 50 and the feed mechanism 20 or unloading mechanisms 70. Thereby, the workpieces 200 may be transferred from the feed mechanism 20 to the classification module 50 or from the classification module 50 to the unloading mechanisms 70 directly. The number of transfer mechanisms 30 may be one which can move on the supporting frame 10 of the sorting device 100 so as to transfer the workpieces 100 to different mechanisms.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A sorting device, comprising:

a supporting frame;

a feed mechanism supporting trays bearing pre-sorted workpieces, and supported by the supporting frame;

a classification module comprising a support mechanism, a measurement mechanism, and a marking mechanism, adjacent to the feed mechanism and comprising a plurality of stations to support the workpieces, the measurement mechanism and the marking mechanism being on a same side of the support mechanism and targeting different stations of the support mechanism to measure and mark sort results on the workpieces, wherein the support mechanism, the measurement mechanism, and the marking mechanism are fixed on the supporting frame;

a plurality of unloading mechanisms supporting trays transporting workpieces, supported by the supporting frame; and at least one transfer mechanism fixed on the supporting frame, between the support mechanism and the feed mechanism or the unloading mechanisms;

wherein the unloading mechanisms are adjacent to the support mechanism, the at least one transfer mechanism relocates the pre-sorted workpiece from the feed mechanism to the support mechanism, or from the support mechanism to a corresponding unloading mechanism according to a sorted criteria of the workpiece.

2. The sorting device of claim 1, further comprising a conveyance mechanism, an end of which extends to the support mechanism, wherein at least one of the unloading mechanisms is disposed adjacent to the conveyance mechanism; the conveyance mechanism being fixed on the supporting frame and conveying the workpiece from the support mechanism to a portion adjacent to a corresponding unloading mechanism according to a sorted criteria of the workpiece.

3. The sorting device of claim 2, wherein the conveyance mechanism comprises a driving member, two transmission belts driven by the driving member, and two clamps positioned on the transmission belts and moving with the transmission belts.

4. The sorting device of claim 1, wherein the feed mechanism comprises a support bracket and a plurality of trays on the bracket to carry the workpieces, wherein the trays are movable on the support bracket.

5. The sorting device of claim 4, wherein the feed mechanism further comprises a drawer slidably positioned in the support bracket to support the trays, a drive assembly, and two clipping cylinders, the drive assembly comprising a driving member, a threaded shaft driven by the driving member, a holding member surrounding the trays, and another driving member to direct the holding member to clip the trays to move along the threaded shaft, wherein the two clipping cylinders are positioned on a top of the support bracket, and clip the trays after movement thereof to the top of the support bracket by the holding member.

6. The sorting device of claim 5, wherein at least one of the unloading mechanisms has a same structure as the feed mechanism.

7. The sorting device of claim 1, wherein the at least one transfer mechanism comprises an encoder to read identification codes on the workpieces.

8. The sorting device of claim 7, wherein the at least one transfer mechanism further comprises a plurality of slide rails extending in different directions, a moving member, and a claw mounted thereon; the encoder is fixed on the moving member adjacent to the claw.

9. The sorting device of claim 1, further comprising two relocating mechanisms fixed on the supporting frame, wherein one relocating mechanism is positioned between the feed mechanism to carry the workpiece from the transfer mechanism adjacent to the feed mechanism, and the other relocating mechanism is positioned between the conveyance mechanism and the support mechanism to carry the workpiece from the support mechanism to the conveyance mechanism.

10. The sorting device of claim 9, wherein each relocating mechanism comprises a supporting board and a supporting stage supported by the supporting board; the supporting stage supports the workpiece.

11. The sorting device of claim 1, wherein the support mechanism comprises a turntable and at least one clipping assembly disposed on the turntable, the at least one clipping assembly clipping the workpiece to move together with the turntable.

12. The sorting device of claim 11, wherein the at least one clipping assembly comprises a plurality of clipping legs and a corresponding number of cylinders to drive the clipping legs.

13. The sorting device of claim 12, wherein the turntable defines at least one opening corresponding to the at least one clipping assembly, defined in a portion of the turntable among the clipping legs of the at least one clipping assembly.

14. A sorting device, comprising:

a supporting frame;

a feed mechanism to carry pre-sorted workpieces, and supported by the supporting frame;

a classification module fixed on the supporting frame, comprising a support mechanism having a plurality of stations to support the workpieces, a measurement mechanism and a marking mechanism targeting different stations of the support mechanism, wherein the measurement mechanism and the marking mechanism are on one side of the support mechanism and target different stations on the support mechanism;

a plurality of unloading mechanisms, in a portion adjacent to the classification module and supported by the supporting frame; and at least one transfer mechanism fixed on the supporting frame, and between the classification module and the feed mechanism or the unloading mechanisms, moving the workpieces from the feed mechanism to the classification module or from the classification module to different unloading mechanisms;

at least one relocating mechanism which is on the other side of the support mechanism;

wherein when the workpiece is transferred by the at least one transfer mechanism from the feed mechanism to the support mechanism according to a sorted criteria of the workpiece, the support mechanism moves the workpiece together with the at least one transfer mechanism.

15. The sorting device of claim 14, wherein the at least one relocating mechanism comprises a driving member and a supporting stage, the supporting stage supporting the workpiece.

16. The sorting device of claim 14, further comprising a conveyance mechanism moving the workpiece from the support mechanism to a corresponding portion adjacent to different unloading mechanisms, wherein the unloading mechanisms are positioned adjacent to the conveyance mechanism, and a transfer mechanism between the conveyance mechanism and each unloading mechanism.

17. The sorting device of claim 16, wherein the conveyance mechanism comprises a driving member, two transmission belts driven by the driving member, and two clamps moving with the transmission belts, the clamps clamping the workpieces.

18. The sorting device of claim 14, wherein the support mechanism comprises a turntable and at least one clipping assembly disposed on the turntable, the at least one clipping assembly clipping the workpiece.

* * * * *